US007644833B2

(12) United States Patent
Turner et al.

(10) Patent No.: US 7,644,833 B2
(45) **Date of Patent: *Jan. 12, 2010**

(54) CAN END

(75) Inventors: Timothy Turner, Pecatonica, IL (US); Rajesh Gopalaswamy, Lake Zurich, IL (US); Randall G. Forrest, Park Ridge, IL (US)

(73) Assignee: Rexam Beverage Can Company, Chicago, IL (US)

( * ) Notice: Subject to any disclaimer, the term of this patent is extended or adjusted under 35 U.S.C. 154(b) by 624 days.

This patent is subject to a terminal disclaimer.

(21) Appl. No.: 11/235,653

(22) Filed: Sep. 26, 2005

(65) Prior Publication Data

US 2006/0096994 A1 May 11, 2006

Related U.S. Application Data

(63) Continuation-in-part of application No. 10/846,259, filed on May 14, 2004, now Pat. No. 7,556,168, which is a continuation-in-part of application No. 10/680,644, filed on Oct. 7, 2003, now Pat. No. 7,174,762, and a continuation-in-part of application No. 10/219,914, filed on Aug. 15, 2002, now Pat. No. 7,004,345, which is a continuation-in-part of application No. 09/931,497, filed on Aug. 16, 2001, now Pat. No. 6,772,900.

(51) Int. Cl.
*B65D 17/34* (2006.01)
*B65D 6/28* (2006.01)

(52) U.S. Cl. ..... 220/269; 220/619

(58) Field of Classification Search ..... 220/364, 220/619, 269, 270, 906; 413/18, 19, 8
See application file for complete search history.

(56) References Cited

U.S. PATENT DOCUMENTS 3,186,583 A 6/1965 Zundel
3,434,623 A 3/1969 Cookson (Continued)

FOREIGN PATENT DOCUMENTS

AU 107340 5/1939

(Continued)

OTHER PUBLICATIONS

European Search Report mailed Sep. 4, 2007 in co-pending European Application No. 07012544.8-2308.

*Primary Examiner*—Robin Hylton
(74) *Attorney, Agent, or Firm*—Ungaretti & Harris LLP

(57) ABSTRACT

A can end member for a beverage container is disclosed. The end member has a curl at least substantially defining a perimeter of the can end, a chuck wall extending downwardly and radially inwardly from the curl, and a central panel wall centered about a longitudinal axis. The central panel wall has a product side and a public side. The public side has a means for opening a frangible panel segment. The end member also has a fold joining the chuck wall with the central panel wall. The fold has an opening. A fluid is located adjacent the opening.

16 Claims, 2 Drawing Sheets

U.S. PATENT DOCUMENTS

| | | | | |
|---|---|---|---|---|
| 3,525,455 | A | 8/1970 | Saunders | |
| 3,705,563 | A | 12/1972 | Elser | |
| 3,765,352 | A | 10/1973 | Schubert et al. | |
| 3,837,524 | A | 9/1974 | Schubert et al. | |
| 3,853,080 | A | 12/1974 | Zundel | |
| 3,868,919 | A | 3/1975 | Schrecker et al. | |
| 3,871,314 | A | 3/1975 | Stargell | |
| 3,905,513 | A | 9/1975 | Klein | |
| 3,941,277 | A | 3/1976 | McKinney et al. | |
| 3,945,334 | A | 3/1976 | Ostrem et al. | |
| 3,990,376 | A | 11/1976 | Schubert et al. | |
| 4,031,837 | A | 6/1977 | Jordan | |
| 4,055,134 | A | 10/1977 | Ostrem et al. | |
| 4,084,721 | A | 4/1978 | Perry | |
| 4,093,102 | A | 6/1978 | Kraska | |
| 4,116,361 | A | 9/1978 | Stargell | |
| 4,324,343 | A | 4/1982 | Moller | |
| 4,434,641 | A | 3/1984 | Nguyen | |
| 4,448,322 | A | 5/1984 | Kraska | |
| 4,571,978 | A | 2/1986 | Taube et al. | |
| 4,577,774 | A | 3/1986 | Nguyen | |
| 4,641,761 | A | 2/1987 | Smith et al. | |
| 4,680,917 | A | 7/1987 | Hambleton et al. | |
| 4,685,849 | A | 8/1987 | LaBarge et al. | |
| 4,704,887 | A | 11/1987 | Bachmann et al. | |
| 4,722,215 | A | 2/1988 | Taube et al. | |
| 4,804,106 | A | 2/1989 | Saunders | |
| 4,832,223 | A | 5/1989 | Kalenak et al. | |
| 4,991,735 | A | 2/1991 | Biondich | |
| 5,069,355 | A | 12/1991 | Matuszak | |
| 5,105,977 | A | 4/1992 | Taniuchi | |
| 5,143,504 | A | 9/1992 | Braakman | |
| 5,149,238 | A | 9/1992 | McEldowney et al. | |
| 5,174,706 | A | 12/1992 | Taniuchi | |
| 5,346,087 | A | 9/1994 | Klein | |
| 5,823,730 | A | 10/1998 | La Rovere | |
| 5,950,858 | A | 9/1999 | Sergeant | |
| 6,024,239 | A | 2/2000 | Turner et al. | |
| 6,065,634 | A | 5/2000 | Brifcani et al. | |
| 6,089,072 | A | 7/2000 | Fields | |
| 6,234,337 | B1 | 5/2001 | Huber et al. | |
| 6,296,137 | B1 * | 10/2001 | Bjornsen | 220/257.2 |
| 6,419,110 | B1 | 7/2002 | Stodd | |
| 6,425,721 | B1 | 7/2002 | Zysset | |
| 6,499,622 | B1 | 12/2002 | Neiner | |
| 6,772,900 | B2 * | 8/2004 | Turner et al. | 220/269 |
| 7,004,345 | B2 | 2/2006 | Turner et al. | |
| 7,036,348 | B2 | 5/2006 | McClung | |
| 2001/0037668 | A1 | 11/2001 | Fields | |
| 2002/0050493 | A1 | 5/2002 | Ball et al. | |
| 2002/0158071 | A1 | 10/2002 | Chasteen et al. | |
| 2004/0206764 | A1 | 10/2004 | Gardiner | |
| 2005/0006388 | A1 * | 1/2005 | Turner et al. | 220/269 |

FOREIGN PATENT DOCUMENTS

| | | |
|---|---|---|
| DE | 2303943 | 5/1974 |
| DE | 2554264 | 6/1977 |
| DE | 8228681 | 10/1983 |
| FR | 2577897 | 8/1986 |
| GB | 422052 | 6/1934 |
| WO | WO-03016155 | 2/1993 |
| WO | WO-9637414 | 11/1996 |
| WO | WO-9834743 | 8/1998 |
| WO | WO-0141948 | 6/2001 |
| WO | WO-0200512 | 1/2002 |
| WO | WO-0243895 | 6/2002 |
| WO | WO-02057137 | 7/2002 |
| WO | WO-02057148 | 7/2002 |
| WO | WO 03/016155 A1 * | 2/2003 |

* cited by examiner 10
12
14
16
18
32
34
50
54
115
116
117
$R_{END}$
$R_1$
$R_2$
$R_3$
$R_4$
$H_u$ 14
16
18
52
56
58
62
64
66
68
70
120
122
124
$H_{fold}$
λ

14
16
18
52
56
58
62
64
66
68
70
120
122
124
$H_{fold}$
λ

CAN END

RELATED APPLICATION

This application is a continuation-in-part of application Ser. No. 10/846,259 filed on May 14, 2004 now U.S. Pat. No. 7,556,168 which is a continuation-in-part of application Ser. No. 10/680,644 filed on Oct. 7, 2003, now U.S. Pat. No. 7,174,762, and application Ser. No. 10/219,914 filed on Aug. 15, 2002, now U.S. Pat. No. 7,004,345, which was a continuation-in-part of application Ser. No. 09/931,497 which was filed on Aug. 16, 2001, now U.S. Pat. No. 6,772,900. The applications are commonly assigned and incorporated by reference herein.

TECHNICAL FIELD

The present invention relates to end closures for two-piece beer and beverage metal containers having a fold located between the chuck wall and the central panel. More specifically, the present invention relates to a can end having such a fold with a cured fluid therein.

BACKGROUND OF THE INVENTION

Common easy open end closures for beer and beverage containers have a central or center panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

Can ends of this type may be provided with a circumferential countersink located about the periphery of a central panel wall. The countersink improves the buckle strength of the can end. Can ends may also be provided with a circumferential fold located about the periphery of the central panel wall or within the countersink.

Dirt, beverage spillage, and other undesired matter often accumulates in the countersink and/or fold. Because the countersink is a narrow circumferential recess, the foreign matter is difficult to clean. The fold may also trap dirt and other foreign matter though to a lesser extent. However, the fold, in some cases, may be even more difficult to clean than a dirty countersink.

The present invention is provided to solve the problems discussed above and other problems, and to provide advantages and aspects not provided by prior can ends. A full discussion of the features and advantages of the present invention is deferred to the following detailed description, which proceeds with reference to the accompanying drawings.

SUMMARY OF THE INVENTION

One object of the inventions is to provide an end member for a beverage container. The end member has a curl at least substantially defining a perimeter of the can end, a chuck wall extending downwardly and radially inwardly from the curl, and a central panel wall centered about a longitudinal axis. The central panel wall has a product side and a public side. The public side has a means for opening a frangible panel segment. The end member includes a fold joining the chuck wall with the central panel wall. The fold has an opening. A fluid is located adjacent the opening.

Another object of the present invention is to provide an end member for a beverage container. The end member includes a curl at least substantially defining a perimeter of the can end, a chuck wall extending downwardly and radially inwardly from the curl, and a central panel wall centered about a longitudinal axis, the central panel wall having a product side and a public side, the public side having a means for opening a frangible panel segment, the end member. The end further includes a fold joining the chuck wall with the central panel wall. The fold includes first and second circumferential legs joined by a circumferential arcuate segment. The fold has an opening located along the peripheral edge of the central panel. A polymeric insert is located within the opening.

Another object of the present invention si to provide an end member for a beverage container. The end member has a curl at least substantially defining a perimeter of the can end, a chuck wall extending downwardly and radially inwardly from the curl, and a central panel wall centered about a longitudinal axis. The central panel wall has a product side and a public side. The public side has a means for opening a frangible panel segment. The end member further includes a fold joining the chuck wall with the central panel wall. The fold includes first and second circumferential legs joined at first ends by a circumferential arcuate segment. An insert substantially seals the fold. The first and second circumferential legs may have second ends opposite the first ends wherein a spacing between the second ends is less than a spacing between the first ends. A cavity is located between the first and second legs. The cavity has an opening located between the second ends.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
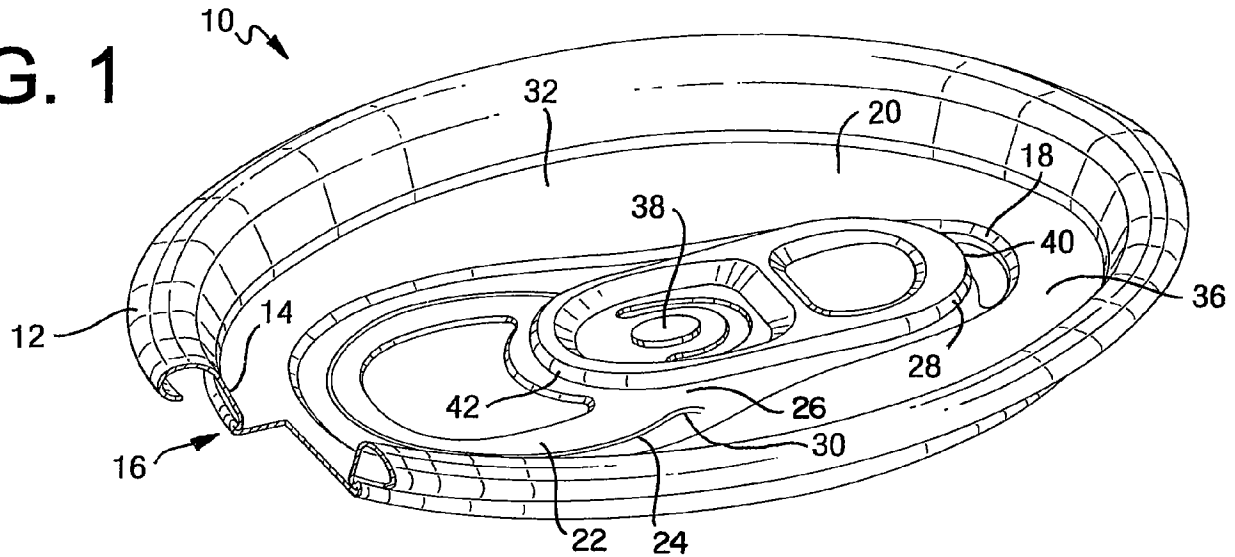
FIG. 1 is perspective view with a cut away showing a can end having a fold.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10. Essentially, the present invention provides a lightweight end member 10 which embodies the physical characteristics and properties required in the beverage container market, as explained below.

Referring to FIG. 1, the end member 10 for a container (not shown) has a seaming curl 12, a chuck wall 14, a transition wall 16, and center or central panel wall 18. The container is typically a drawn and ironed metal can such as the common beer and beverage containers, usually constructed from a thin sheet of aluminum or steel that is delivered from a large roll called coil stock of roll stock. End closures for such containers are also typically constructed from a cut edge of thin sheet of aluminum or steel delivered from coil stock, formed into blank end, and manufactured into a finished end by a process often referred to as end conversion. In the embodiment shown in the Figures, the end member 10 is joined to a container by a seaming curl 12 which is joined to a mating curl of the container. The seaming curl 12 of the end closure 10 is integral with the chuck wall 14 which is joined to an outer peripheral edge portion 20 of the center panel 18 by the transition wall 16. This type of means for joining the end member 10 to a container is presently the typical means for joining used in the industry, and the structure described above is formed in the process of forming the blank end from a cut edge of metal sheet, prior to the end conversion process. However, other means for joining the end member 10 to a container may be employed with the present invention.

The center panel 18 has a displaceable closure member. In FIG. 1, the displaceable closure member is a conventional tear panel 22. The tear panel 22 is defined by a curvilinear frangible score 24 and a non-frangible hinge segment 26. The hinge segment 26 is defined by a generally straight line between a first end and a second end 30 of the frangible score 24. The tear panel 22 of the center panel 18 may be opened, that is the frangible score 24 may be severed and the tear panel 22 displaced at an angular orientation relative to the remaining portion of the center panel 18, while the tear panel 22 remains hingedly connected to the center panel 18 through the hinge segment 26. In this opening operation, the tear panel 22 is displaced at an angular deflection, as it is opened by being displaced away from the plane of the panel 18.

The frangible score 24 is preferably a generally V-shaped groove formed into the public side 32 of the center panel 18. A residual is formed between the V-shaped groove and the product side 34 of the end member 10.

The end member 10 has a tab 28 secured to the center panel 18 adjacent the tear panel 22 by a rivet 38. The rivet 38 is formed in the typical manner.

During opening of the end member 10 by the user, the user lifts a lift end 40 of the tab 28 to displace a nose portion 42 downward against the tear panel 22. The force of the nose portion 42 against the tear panel 22 causes the score 24 to fracture. As the tab 28 displacement is continued, the fracture of the score 24 propagates around the tear panel 22, preferably in progression from the first end of the score 24 toward the second end 30 of the score 24.

Figure 2:
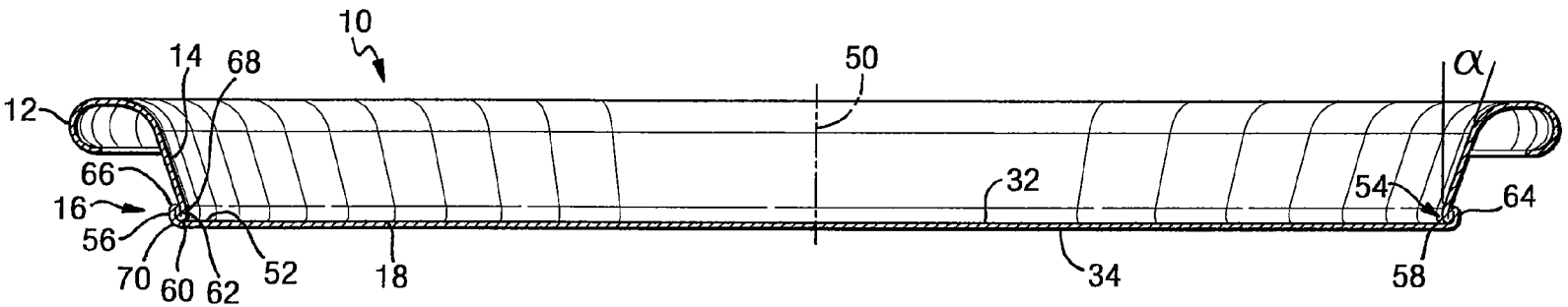
FIG. 2 is a cross-sectional view of a can end having a fold.
Figure 3:
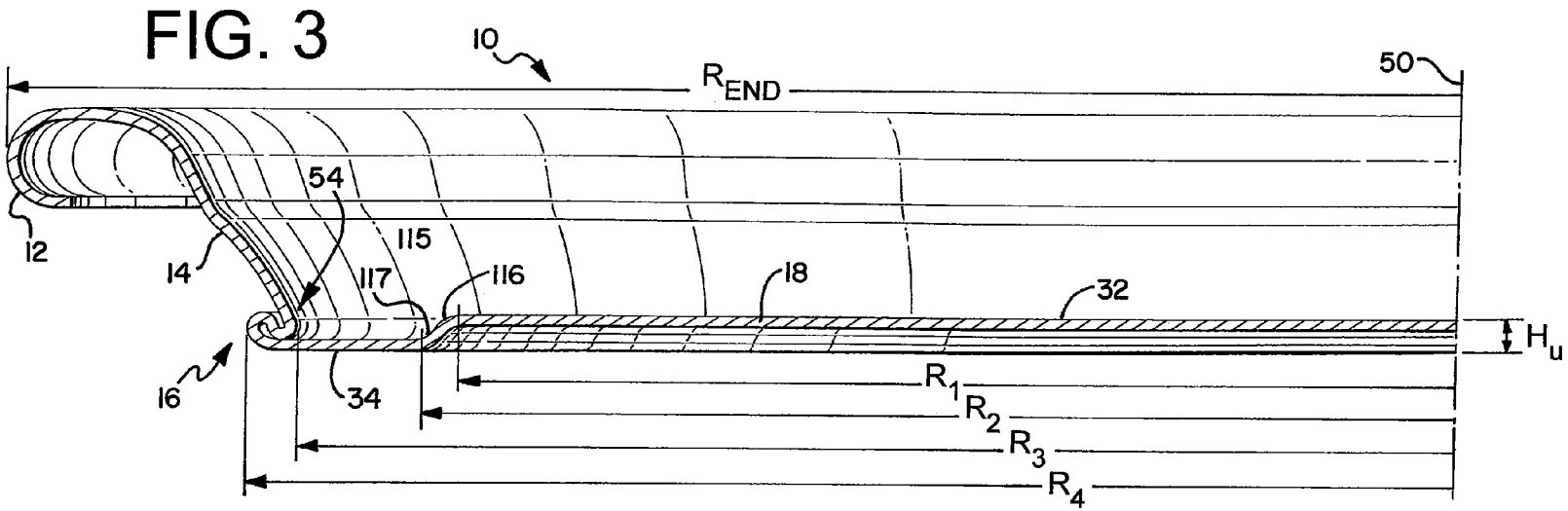
FIG. 3 is a partial cross-sectional view of a can end having a fold.

Now referring to FIG. 2, the center panel 18 is centered about a longitudinal axis 50 which is perpendicular to a diameter of the center panel 18. The seaming curl 12 defines an outer perimeter of the end member 10 and is integral with the chuck wall 14. The chuck wall 14 extends downwardly from the seaming curl 12 at an angle $\alpha$.

The transition wall 16 is integral with the chuck wall 14 and connects the chuck wall 14 to the peripheral edge portion 52 of the center panel 18. The planar peripheral edge portion 52 allows the tear panel 24 to be placed closer to the outer perimeter of the end member 10. It also provides additional center panel 18 area for printing and/or a larger tear panel opening.

Figure 4:
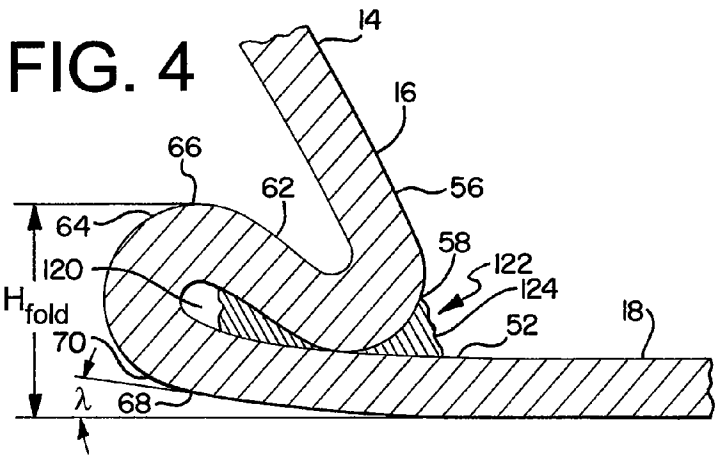
FIG. 4 is a greatly enlarged cross-sectional view of a fold with an insert therein.

The transition wall 16 includes a fold 54 extending outwardly relative to the longitudinal axis 50. The drawings show the fold 54 having a portion located radially outwardly of the chuck wall and formed along an exterior portion of the chuck wall 14; however, it should be understood that the fold 54 can be located in other locations such as along the product side 34 of the center panel 18. However, the fold 54 preferably extends upwardly at an angle $\lambda$ of about 8° above a horizontal plane. (See FIGS. 4 and 5).

The fold 54 includes a plurality of circumferential legs. A first leg 56 connects the chuck wall 14 to an annular concave bend or circumferential arcuate segment 58. The annular concave portion 58 includes an apex 60 which approaches so as to preferably engage the outer peripheral edge 52 of the center panel 18. This contact between the apex 60 and the outer peripheral edge 52 helps to prevent dirt from accumulating along the peripheral edge 52 of the center panel 18. It also allows the center panel 18 to be easily cleaned when dirt or other residue is present on the center panel 18.

A second leg 62 extends upwardly from the annular concave portion 58 to an annular convex bend or portion 64. The second leg 62 can be vertical, substantially vertical, or up to ±25 degrees to the longitudinal axis 50 and can be pressed against an outer portion of the first leg 56.

The annular convex portion 64 includes an apex 66 which defines a vertical extent of the fold 54. A length of the fold 54 is substantially less than a length of the seaming curl 12. In combination with, inter alia, the angled chuck wall 14, this fold 54 structure and length allows the buckling strength of the end member 10 to meet customer requirements while decreasing the size of the cut edge blank and maintaining the diameter of the finished end. In other words, a smaller cut edge blank can be provided to produce the same sized diameter end member as a larger cut edge blank formed in the conventional manner with a countersink.

A third leg 68 extends downwardly from the annular convex portion 64 to a third bend 70 which joins the transition wall 16 to the outer peripheral edge 52 of the center panel 18. The third bend 70 has a radius of curvature which is suitable for connecting the third leg 68 to the planar outer peripheral edge of the center panel 18.

The end member 10 further comprises a center panel 18 having an upward step 115. The step has a depth $H_U$ of about 0.02 ins. (0.51 mm). The upwardly oriented step 115 increases the buckle strength characteristic of the end member 10. Buckle strength improves as the step 115 is located radially inwardly of the fold 54. However, as the radial distance between the fold 54 and the step 115 increases, the area of the center panel 18 that is available for lettering decreases. Therefore, these relationships must be optimized to allow for a sufficient area for printed information while maintaining sufficient buckle strength.

The upwardly oriented step 115 has a concave annular radially innermost portion 117 joined to a convex annular radially outermost portion 116. These annular portions have radii of curvature of about 0.015 ins. (0.381 mm), and may be coined during forming to prevent the fold 54 from adverse deformation. The radially innermost portion of the step 115 is located a distance $R_1$ of about 0.804 ins. (20.422 mm) from the center of the end member 10. The radially outermost portion of the step 115 is located a distance $R_2$ of about 0.8377 ins. (21.2776 mm) from the center of the end member 10. The fold 54 of this embodiment has a radially inner most portion located at a distance $R_3$ of about 0.9338 ins. (23.7185 mm) from the center of the end member 10, and a radially outermost portion located at a distance $R_4$ of about 0.9726 ins. (24.7040 mm) from the center of the end member 10. The end member 10 has a radius $R_{end}$ of about 1.167 ins. (29.642 mm).

These dimensions are directed to a 202 end member. One of ordinary skill in the art would recognize that these principles could be applied to an end member of any diameter. The dimensions would increase or decrease depending on the relative size of the end member, preferably proportionally.

Figure 5:
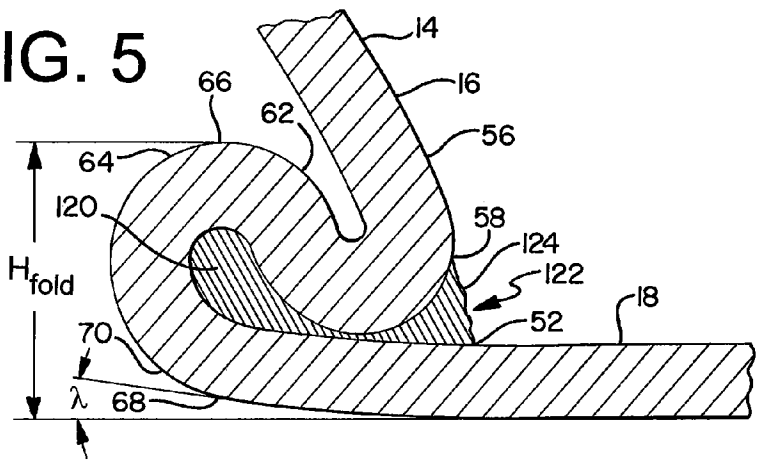
FIG. 5 is a greatly enlarged cross-sectional view of a fold with an insert.

Now referring to FIG. 5, the fold 54 may not contact the center panel 18. Once the container is pressurized, the distance between the apex 60 and the center panel 18 is reduced or eliminated to create a clean end. As the fold 54 is circumferential, portions of the apex 60 may contact the center panel 18; the apex 60 may contact the center panel 18 along its entire circumference; or no portion of the apex 60 may contact the center panel 18.

The fold 54 has an inner radius of curvature joining or connecting the second leg 62 with the third leg 68. This radius of curvature is preferably 0 ins. to 0.030 ins. (0 mm to 0.76 mm); more preferably 0.002 ins. to 0.020 ins. (0.051 mm to 0.51 mm); still more preferably 0.0035 ins. to 0.010 ins. (0.089 mm to 0.25 mm); and most preferably 0.006 ins. (0.15 mm); or any range or combination of ranges therein.

The fold 54 has an outer radius of curvature joining or connecting the first leg 56 with the second leg 62. This radius of curvature is preferably less than the inner radius of curvature. This outer radius of curvature is preferably 0 ins. to 0.030 ins. (0 mm to 0.76 mm); more preferably 0.002 ins. to 0.020 ins. (0.051 mm to 0.51 mm); still more preferably 0.0035 ins. to 0.010 ins. (0.089 mm to 0.254 mm); or any range or combination of ranges therein.

The second leg 62 and third leg 68 each have opposing first and second ends. The first end of the second leg 62 is joined to the concave annular portion 58; the opposing second end of the second leg 62 is joined to the convex annular portion 64; the first end of the third leg 68 is joined to the convex annular portion 64, and the opposing second end of the third leg 68 is interconnected to the center panel 18. The first end of the second leg 62 and the second end of the third leg 68 converge so that a distance between the apex 60 and the center panel 18 is reduced or eliminated, and the distance between the second end of the second leg 62 and the first end of the third leg 68 is greater than the distance between the first end of the second leg 62 and the second end of the third leg 68. The relative magnitudes of the inner and outer radii of curvature help create this spatial relationship which is believed to contribute significant increases in the strength of the can end 10. It is further believed that the strength of the can end 10 can be dramatically increased by forming the legs with a curvilinear shape, e.g. a radius of curvature or bow-shape, e.g. second leg 62, such that the convex annular portion 64 is positioned adjacent to or engages an outer surface of the chuck wall 14.

When formed in this manner, the second and third legs 62, 64 are spaced such that a cavity 120 is formed within the fold 54, and a slight opening 122 to the fold 54 may be located along the planar peripheral edge of the central panel 18. The cavity 120 and the opening 122 are preferably circumferential; however, the opening 122 which serves as an access to the cavity 120 may be located at a discreet point along the peripheral edge of the central panel 18. An insert 124 is located adjacent the opening 122, within the cavity and/or along the peripheral edge of the central panel 18, preferably within the cavity 120, the opening 122 and extending very slightly to the peripheral edge of the central panel 18.

The insert 124 is formed as a fluid is injected within the cavity 120. Fluid is intended to include a subset of phases of matter. The fluid includes liquids, gases, plasmas and, to some extent, plastic solids. In other words, the fluid can be any substance that flows, either liquid or gas, but including some solids. The fluid becomes solid or semisolid once in position adjacent the opening 122.

Once the fluid becomes solid or semisolid, the insert 124 is thus formed, and the cavity 120 is preferably substantially sealed wherein dirt and other foreign objects may not accumulate within the cavity 120. This sealing may occur at the opening 122 while a portion of the cavity 120 remains vacant; the cavity 120 may be substantially filled, where any minor volumes of trapped gas have very little or no adverse affect on the resistance to the accumulation of dirt or the overall strength of the can end 10. In any case, the insert 124 in substantially sealing the cavity 120 limits the transfer of matter between the cavity 120, the opening 122, and the surrounding area of the central panel 18 including the peripheral edge.

The fluid may be applied through the opening 122 as the can end 10 rotates or is spun about the longitudinal axis. A source of fluid pressure is provided to inject the fluid into the opening 122. As the can end 10 rotates the fluid fills the cavity 120 with the desired amount of fluid. The fluid is then cured to form a solid or semisolid insert 124 adjacent the opening 122 or within the cavity 120 and/or opening 122. In its broadest sense, curing is the process by which the fluid becomes solid or semisolid. This can occur by cooling, drying, or crystallization. This includes toughening or hardening of a polymer material by cross-linking of polymer chains, brought about by chemical additives, ultraviolet radiation or heat, and vulcanization in the case of a rubbers. Once within the opening in this manner, the insert 124 has been found to increase the strength of the can end, wherein a lower volume of metal can be used to produce the same sized can end In an alternative embodiment; the fluid is applied to the opening 122, but the fold 54 does not include a cavity 120, or the cavity is extremely small.

The terms "first," "second," "upper," "lower," etc. are used for illustrative purposes only and are not intended to limit the embodiments in any way. The term "plurality" as used herein is intended to indicate any number greater than one, either disjunctively or conjunctively as necessary, up to an infinite number. The terms "joined" and "connected" as used herein are intended to put or bring two elements together so as to form a unit, and any number of elements, devices, fasteners, etc. may be provided between the joined or connected elements unless otherwise specified by the use of the term "directly" and supported by the drawings.

This application includes numerous dimensional relationships which are directed to a 202 can end, namely those dimensions directed at radial placement of the fold and/or the step, the diameter or radius of the seaming curl and/or center panel, etc. One ordinary skilled in the art would recognize that these dimensions would change if the inventive aspects disclosed herein were applied to larger or smaller ends, including but not limited to 200, 206, and 209 can ends.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

What is claimed is:

1. An end member for a beverage container, the end member having a curl at least substantially defining a perimeter of the can end, a chuck wall extending downwardly and radially inwardly from the curl, and a central panel wall centered about a longitudinal axis, the central panel wall having a product side and a public side, the public side having a means for opening a frangible panel segment, the end member comprising:

a fold joining said chuck wall with the central panel wall, said fold having an opening and first and second circumferential legs having opposing first and second ends, said first ends joined by an arcuate segment and spaced apart by said arcuate segment forming a cavity therebetween, said first and second legs converging towards one another such that a distance between said second ends is less than a distance between said first ends, the opening located adjacent said second ends; and a fluid located adjacent said opening.

2. The end member of claim 1 wherein said fluid is cured to become at least a semisolid.

3. The end member of claim 2 wherein said at least a semisolid substantially seals said opening in said fold.

4. The end member of claim 1 wherein said fluid enters said cavity through said opening.

5. The end member of claim 4 wherein said cavity is substantially filled with said fluid.

6. The end member of claim 5 wherein said fluid is cured to become at least a semisolid.

7. The end member of claim 6 wherein said at least a semisolid substantially seals said opening.

8. The end member of claim 1 wherein the fluid is within said opening.

9. An end member for a beverage container, the end member comprising:

a curl at least substantially defining a perimeter of the can end;

a chuck wall extending downwardly and radially inwardly from the curl;

a central panel wall centered about a longitudinal axis, the central panel wall having a product side and a public side, the public side having a means for opening a frangible panel segment;

a fold joining said chuck wall with said central panel wall, said fold including first and second circumferential legs joined by a circumferential arcuate segment, said fold further including an opening located along a peripheral edge of the central panel; and a polymeric insert located within said opening, wherein said fold includes a cavity between said first and second legs, at least a portion of said polymeric insert located within said cavity and substantially sealing said opening.

10. The end member of claim 9 wherein said polymeric insert is produced from a fluid cured within said cavity.

11. The end member of claim 10 wherein said fluid is injected into said cavity.

12. The end member of claim 9 wherein a portion of said fold is located radially outwardly of said chuck wall.

13. An end member for a beverage container, the end member having a curl at least substantially defining a perimeter of the can end, a chuck wall extending downwardly and radially inwardly from the curl, a central panel wall centered about a longitudinal axis, the central panel wall having a product side and a public side, the public side having a means for opening a frangible panel segment, the end member comprising:

a fold joining said chuck wall with the central panel wall, said fold including first and second circumferential legs joined at respective first ends by a circumferential arcuate segment, and said fold having a radially outermost portion located radially outwardly from the chuck wall; and an insert substantially sealing said fold.

14. The end member of claim 13 wherein said insert is a cured fluid located within said fold.

15. The end member of claim 14 wherein said cured fluid is a polymeric material.

16. The end member of claim 13 wherein said first and second circumferential legs have second ends opposite said first ends wherein a spacing between said second ends is less than a spacing between said first ends, and a cavity is located between said first and second legs, said cavity having an opening located between said second ends wherein said insert is located within said opening.

* * * * *